US008033965B1

(12) United States Patent
Krull

(10) Patent No.: US 8,033,965 B1
(45) Date of Patent: Oct. 11, 2011

(54) ADJUSTABLE WEIGHT KETTLEBELL APPARATUS

(76) Inventor: Mark A. Krull, New Braunfels, TX (US)

( * ) Notice: Subject to any disclaimer, the term of this patent is extended or adjusted under 35 U.S.C. 154(b) by 7 days.

(21) Appl. No.: 12/661,374

(22) Filed: Mar. 16, 2010

Related U.S. Application Data

(60) Provisional application No. 61/210,446, filed on Mar. 18, 2009.

(51) Int. Cl.
*A63B 21/075* (2006.01)

(52) U.S. Cl. ..... 482/108; 482/107

(58) Field of Classification Search ..... 482/92–94, 482/97–99, 106–109
See application file for complete search history.

(56) References Cited

U.S. PATENT DOCUMENTS

| | | | | |
|---|---|---|---|---|
| 90,304 | A * | 5/1869 | Reilly | 482/94 |
| 1,138,196 | A * | 5/1915 | Diehl | 482/106 |
| 1,316,683 | A * | 9/1919 | Calvert | 482/93 |
| 1,917,566 | A * | 7/1933 | Wood | 482/108 |
| 5,876,313 | A * | 3/1999 | Krull | 482/98 |
| 7,252,627 | B2 * | 8/2007 | Carter | 482/98 |
| 7,381,157 | B2 * | 6/2008 | Blateri | 482/50 |
| 7,413,532 | B1 * | 8/2008 | Monsrud et al. | 482/99 |
| 7,491,157 | B1 * | 2/2009 | Lin | 482/108 |
| 7,563,208 | B1 * | 7/2009 | Chen | 482/93 |
| 7,708,672 | B2 * | 5/2010 | Gibson et al. | 482/98 |
| 7,731,640 | B1 * | 6/2010 | Chen | 482/93 |
| 7,762,933 | B1 * | 7/2010 | Yu | 482/107 |
| 7,811,212 | B2 * | 10/2010 | Chen | 482/107 |
| 2005/0003931 | A1 * | 1/2005 | Mills et al. | 482/5 |
| 2006/0217245 | A1 * | 9/2006 | Golesh et al. | 482/94 |
| 2010/0120588 | A1 * | 5/2010 | Krull | 482/93 |
| 2010/0120589 | A1 * | 5/2010 | Krull | 482/93 |

* cited by examiner

*Primary Examiner* — Loan Thanh
*Assistant Examiner* — Victor K Hwang

(57) ABSTRACT

An adjustable weight kettlebell includes a weight lifting member that houses a vertical stack of weights. Shelves on the housing portion of the weight lifting member are rotatable into and out of underlying engagement with respective weights.

21 Claims, 7 Drawing Sheets

ADJUSTABLE WEIGHT KETTLEBELL APPARATUS

CROSS-REFERENCE TO RELATED APPLICATION

Disclosed herein is subject matter that is entitled to the filing date of U.S. Provisional Application No. 61/210,446, filed Mar. 18, 2009.

FIELD OF THE INVENTION

The present invention relates to exercise equipment and in a preferred application, to methods and apparatus for adjusting weight on an exercise kettlebell.

BACKGROUND OF THE INVENTION

Past efforts have led to various inventions directed toward adjustable weight exercise devices. Despite many advances in the field of weight lifting equipment, room for continued improvement remains with respect to adjusting weight resistance to exercise.

SUMMARY OF THE INVENTION

The present invention provides methods and apparatus for adjusting weight resistance by selectively securing desired amounts of mass to a handlebar or other weight lifting member. A preferred embodiment of the present invention may be described in terms of a kettlebell having a handle, a weight supporting section or housing secured to the handle and disposed beneath the handle, and weights sized and configured to occupy the weight supporting section. The weight housing is rotated relative to the weights to selectively engage and disengage the weights. A latch selectively locks the weight housing against rotation relative to the weights. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
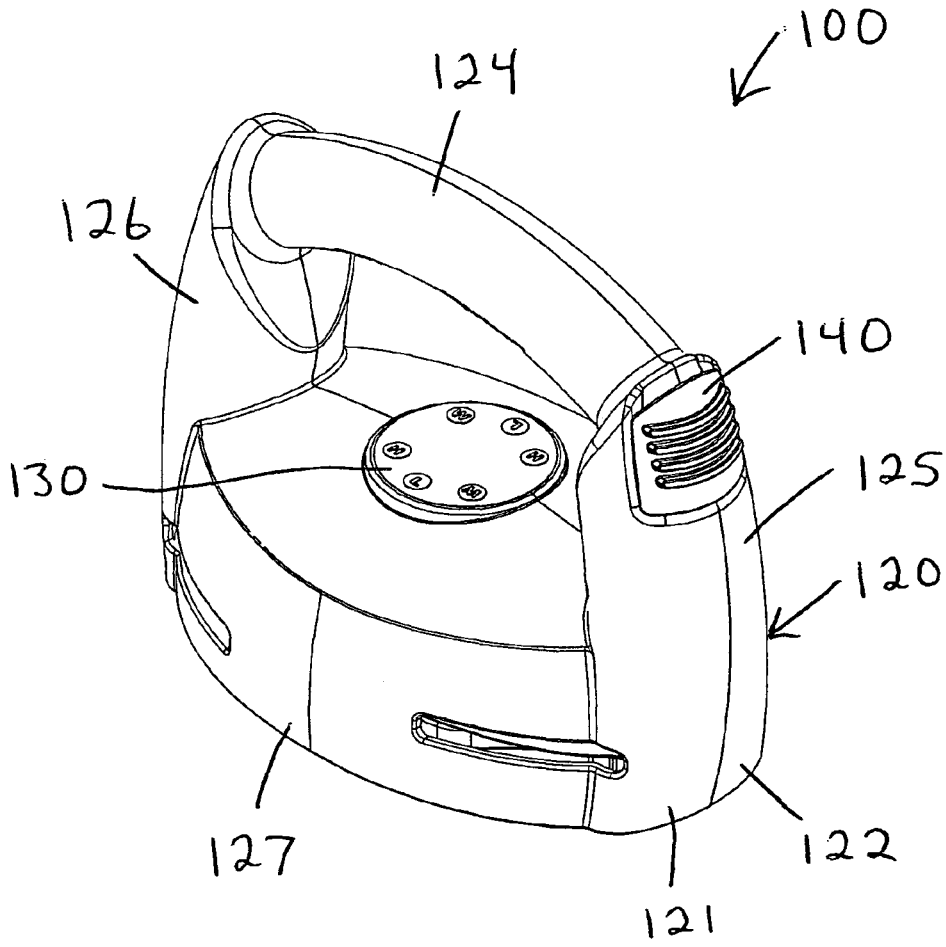
FIG. 1 is a perspective view of a preferred embodiment adjustable weight kettlebell constructed according to the principles of the present invention.

FIGS. 1-6 show an exercise kettlebell 100 constructed according to the principles of the present invention. Generally speaking, the kettlebell 100 includes a weight lifting member or handle member 120, and at least two weights 180 and 190 selectively secured thereto.

The weight lifting member 120 is preferably made by connecting two injection molded parts or halves 121 and 122 to one another (via sonic welding, adhesive, fasteners, snap fit, and/or other suitable means known in the art). The weight lifting member 120 includes a centrally located, horizontal handlebar 124 that is sized and configured for grasping, and that preferably has an elliptical cross-section. The handlebar 124 is integrated into the molded parts 121 and 122, but may be provided as a separate part in the alternative. The handlebar 124 may be provided with an outer gripping surface, such as a vinyl overcoat or over-molded rubber, for example. The weight lifting member 120 also includes left and right, vertical members 125 and 126, which cooperate with the handlebar 124 to define an inverted U-shaped configuration.

Figure 2:
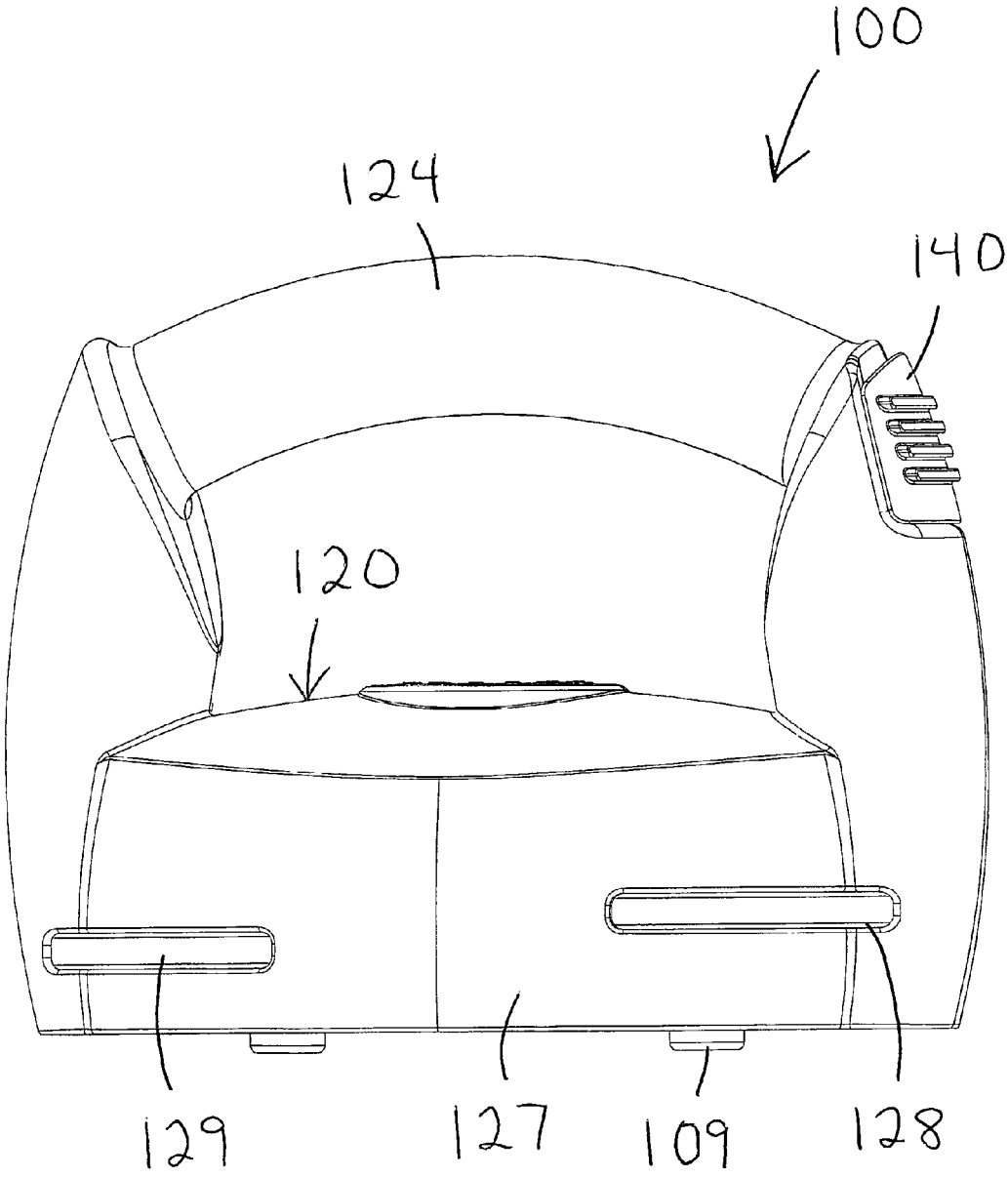
FIG. 2 is a front view of the kettlebell of FIG. 1.

The lower ends of the members 125 and 126 are connected to respective ends of a weight supporting section 127, which may be described as a downwardly opening housing or shell that is preferably sized and configured to cover, encompass, and fit over the weights 180 and 190. The sections 125 and 126 establish a gap or space between the handle 124 and the top of the housing 127. Starting from a neutral or intermediate orientation, the weight supporting section 127 is sized and configured to rotate ten degrees in a first direction relative to the weights 180 and 190, and alternatively, ten degrees in an opposite, second direction relative to the weights 180 and 190. The associated rotational axis extends perpendicular to the drawing sheet of FIG. 3, and its location is designated as X. Diametrically opposed slots 128 in the weight supporting section 120, one of which is shown in FIG. 2, accommodate tabs 188 on the upper weight 180 when the weight supporting section 120 is rotated in the first direction. Similarly, relatively lower, diametrically opposed slots 129 in the weight supporting section 120, one of which is shown in FIG. 2, accommodate tabs 199 on the lower weight 190 when the weight supporting section 120 is rotated in the second direction.

Each slot 128 and 129 defines part of a respective, upwardly facing ledge or shelf. On the preferred embodiment 100, another part of each ledge or shelf is defined by internal ribbing on the sidewalls of the housing 127. On an alternative embodiment, the slots are eliminated, and the shelves are defined entirely by internal ribbing. In any event, each shelf is configured to underlie and lift a respective weight when the housing 127 is oriented accordingly.

The weight lifting member 120 is preferably configured to receive and retain a desired amount of ballast or fixed weight between the two molded parts 121 and 122. On the depicted embodiment 100, the ballast (not shown) cooperates with the other parts of the handle member 120 to define a starting weight or unloaded weight of four pounds. Each of the weights 180 and 190 is configured to weigh three pounds. In other words, the kettlebell 100 is selectively adjustable between four and ten pounds in three pound increments.

A latch 140 is selectively interconnected between the weight lifting member 120 and at least the upper weight 180. On the depicted embodiment 100, the latch 140 is preferably an injection molded plastic part having a button or operator portion, a pin or latching portion, and a spring or biasing portion. The latch 140 is biased to occupy the latched position shown in FIG. 2. The bias is provided by an integrally formed leaf spring that bears against an adjacent portion of the weight lifting member 120. On an alternative embodiment, the bias is provided by a helical coil spring that is compressed between the latch 140 and a proximate portion of the weight lifting member 120.

On the preferred embodiment 100, the weights 180 and 190 are identical to one another, which may be considered desirable for purposes of manufacturing efficiency. Relative to the lower weight 190, the upper weight 180 is flipped one hundred and eighty degrees about a line extending between the two weights 180 and 190, parallel to the parting line between the parts 121 and 122, and through the axis X. On an alternative embodiment, the weights 180 and 190 are configured for relative flipping about a line that perpendicularly intersects both the preferred embodiment flipping line and the axis X. On still other embodiments, discrete alternative weights are substituted for the weights 180 and 190.

Figure 3:
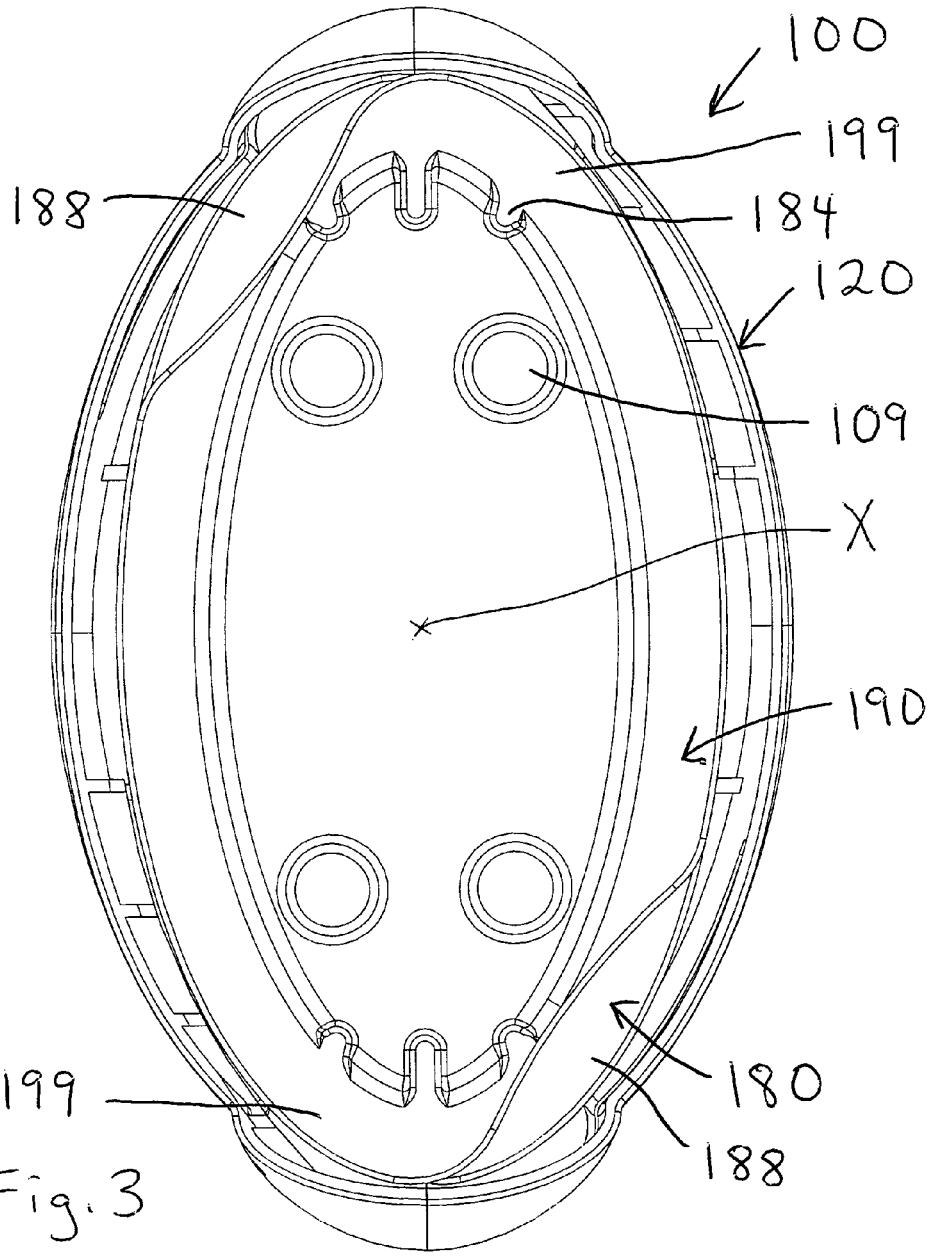
FIG. 3 is a bottom view of the kettlebell of FIG. 1.
Figure 4:
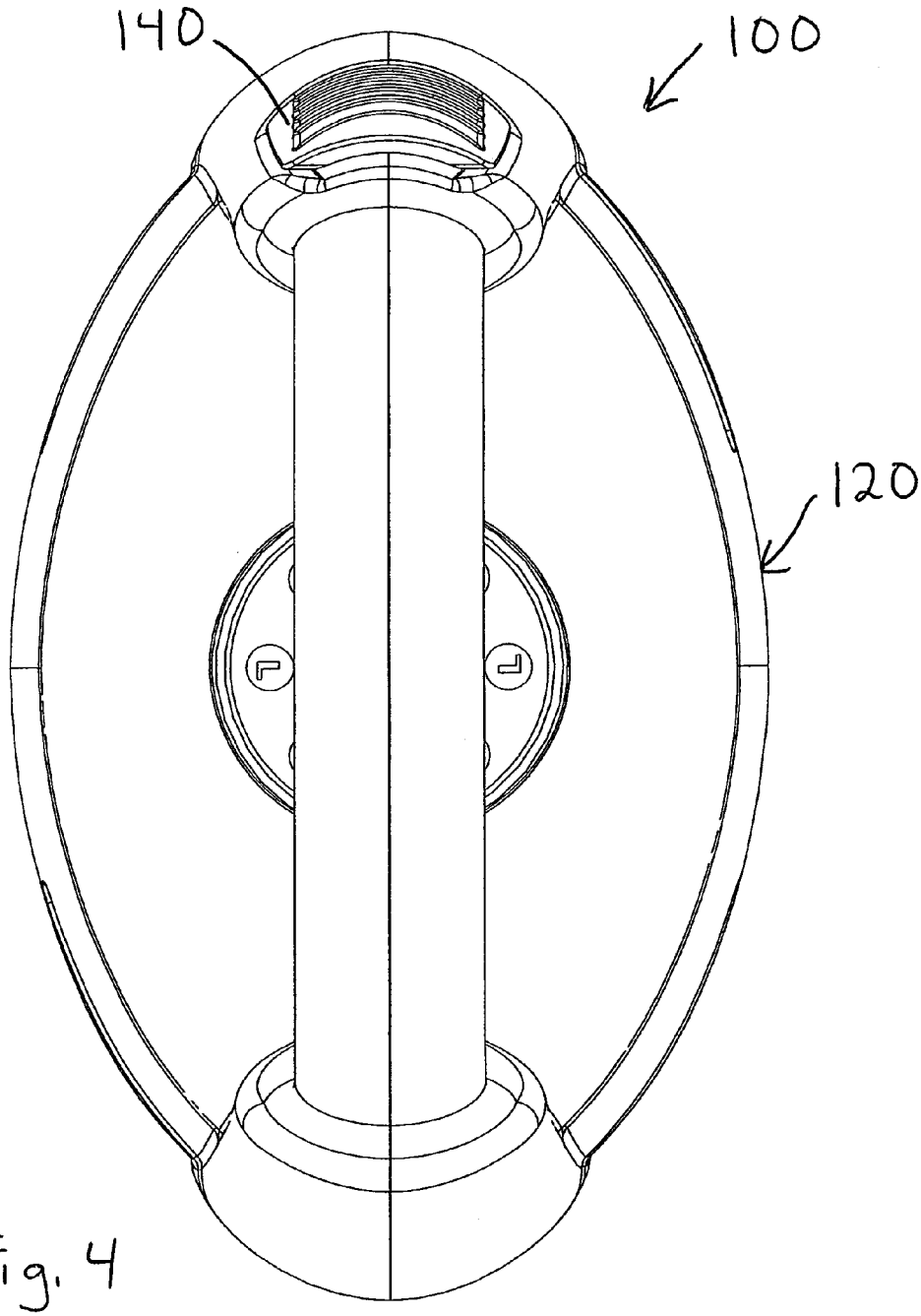
FIG. 4 is a top view of the kettlebell of FIG. 1 set at a low weight setting.
Figure 5:
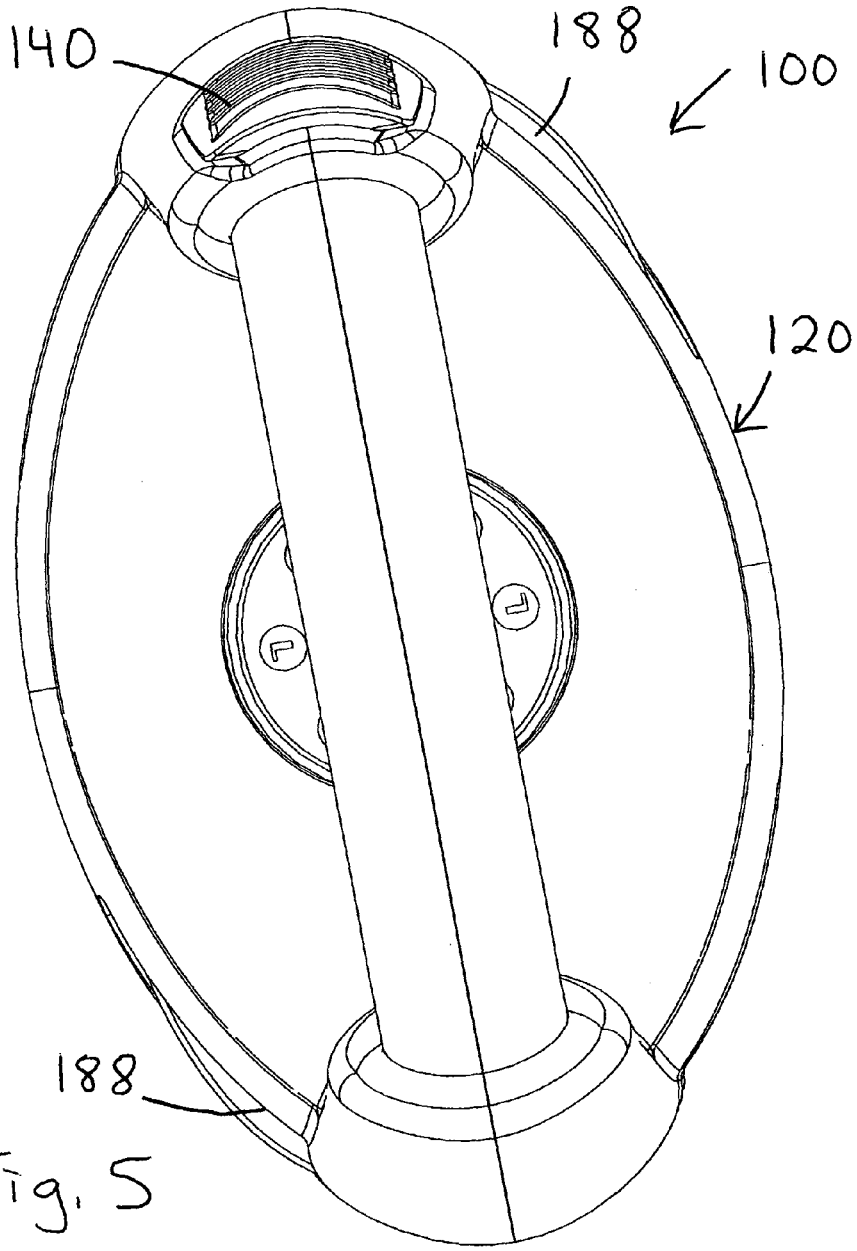
FIG. 5 is a top view of the kettlebell of FIG. 1 set at a medium weight setting.
Figure 6:
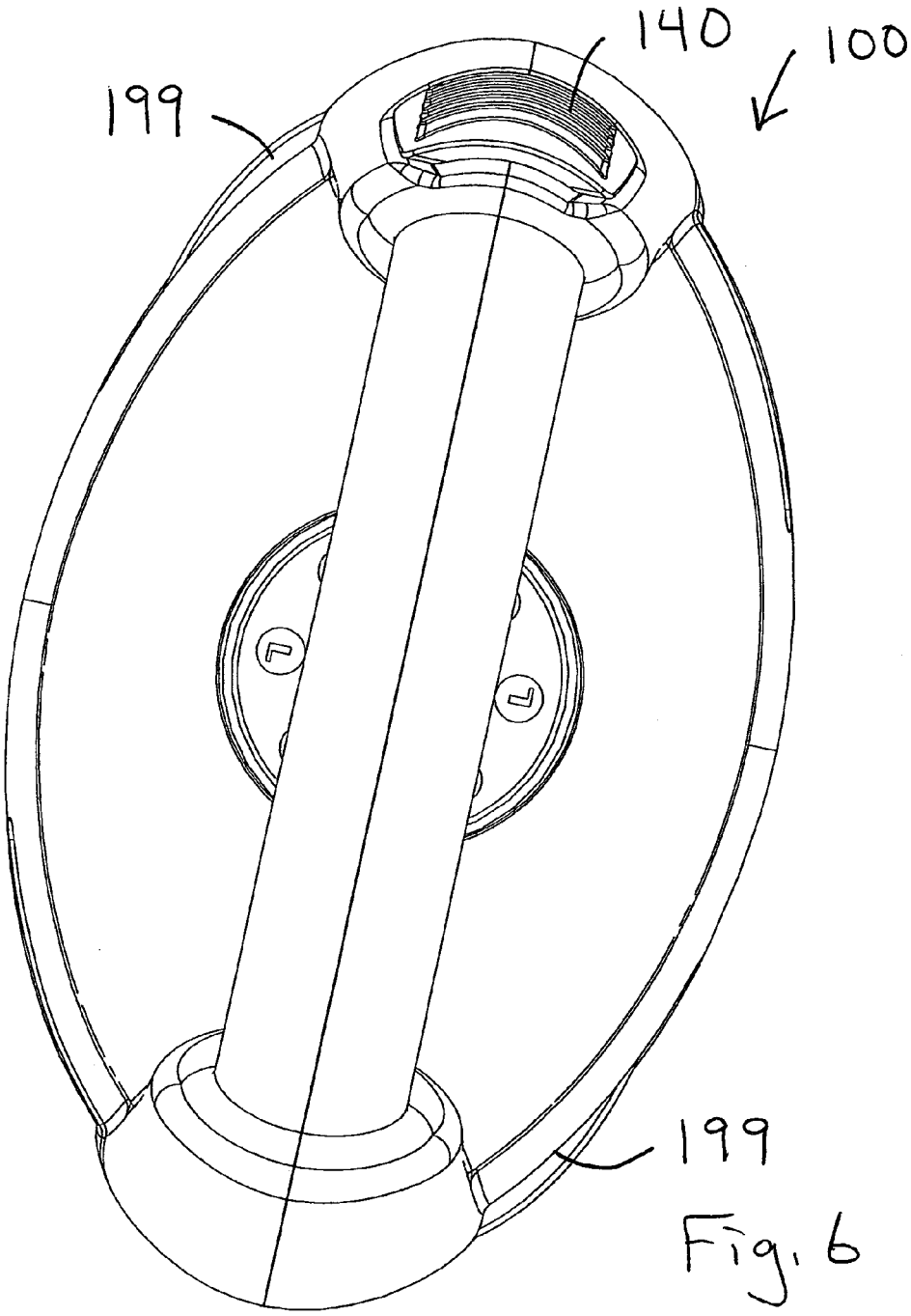
FIG. 6 is a top view of the kettlebell of FIG. 1 set at a high weight setting.

As shown in FIG. 3, each of the weights 180 and 190 has three notches or openings 184 at each end thereof. The openings 184 on the lower weight 190 open downward (and do not perform a function), and the openings 184 on the upper weight 180 open upward (to accommodate the pin portion of the latch 140). FIGS. 4-6 show the weight lifting member 120 in three respective orientations relative to the weights 180 and 190. In each of these orientations, the pin portion of the latch 140 aligns with a respective opening 184 in the upper weight 180. In the absence of user applied force, the pin portion of the latch 140 occupies a respective opening 184, thereby latching the weight lifting member 120 against rotation relative to the weight 180. In response to application of a lifting force on the button portion of the latch 140, by a person's thumb, for example, the pin portion of the latch 140 withdraws from the opening 184, thereby freeing the weight lifting member 120 for rotation relative to the upper weight 180.

Figure 7:
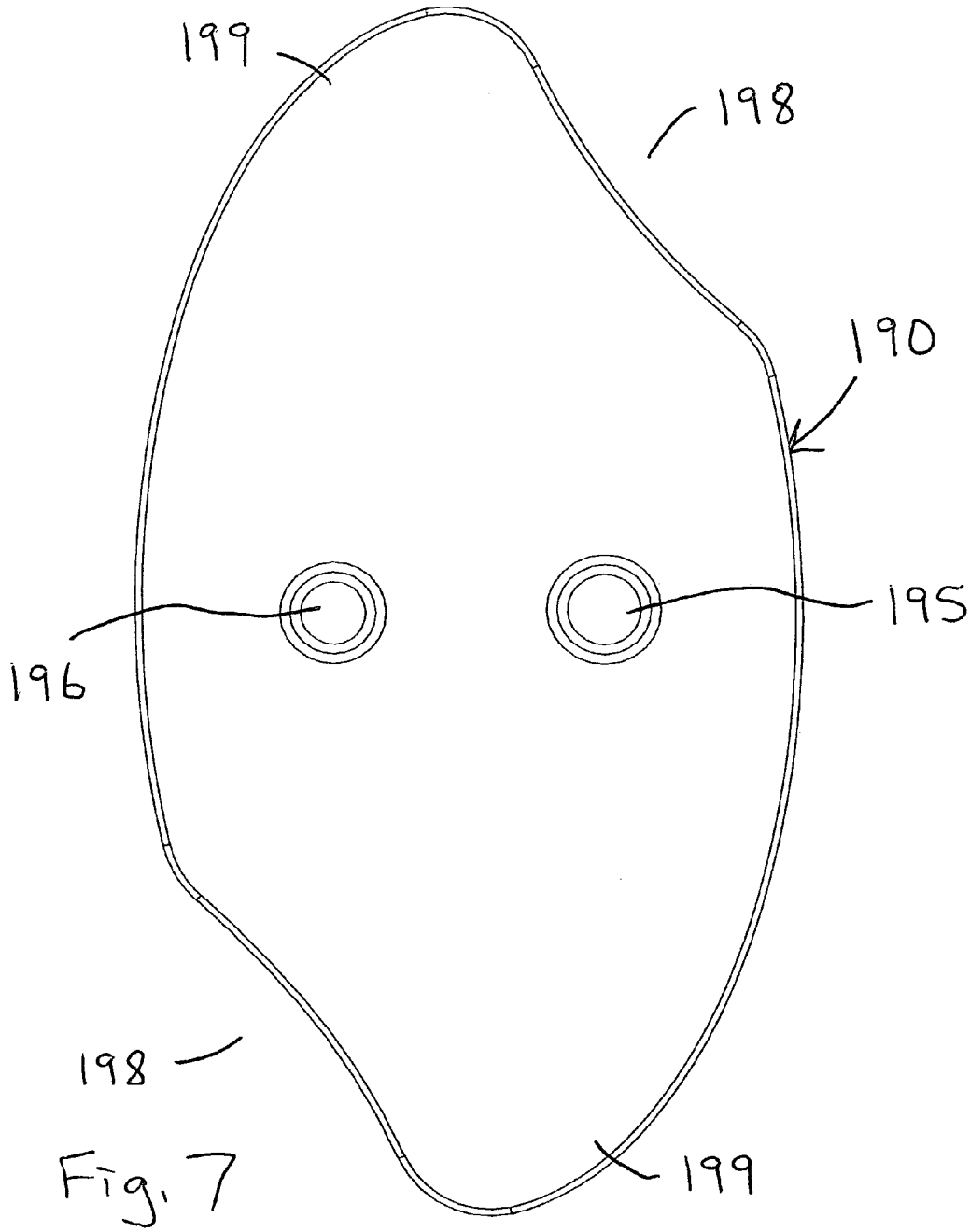
FIG. 7 is a top view of a bottom weight on the kettlebell of FIG. 6 (and visible in FIG. 3).

FIG. 3 shows the bottom of the lower weight 190, and FIG. 7 shows the top of the lower weight 190. Each weight 180 and 190 may be described in terms of two integrally connected plates or levels. The smaller plate or level has an elliptical perimeter that is interrupted only by the openings 184 at each end thereof. Four recesses extend into the smaller plate, and on the lower weight 190, pads or feet 109, which are preferably made of rubber, are secured within the recesses. The larger plate or level has an elliptical perimeter that is interrupted by diametrically opposed notches 198. The notches 198 accommodate rotation of the housing 127 in a counter-clockwise direction (when viewed from above) without engagement of the lower weight 190 by the housing 127. Similar notches on the upper weight 180 accommodate rotation of the housing in a clockwise direction (when viewed from above) without engagement of the upper weight 180 by the housing 127. A centrally located bore may be provided in at least the top of the upper weight 180 (and bottom of the lower weight 190) to align with the axis X and accommodate a complementary peg extending downward from the top of the housing 127, thereby defining a rotational registration between the weight lifting member 120 and the upper weight 180.

A registration peg 195 projects outward from the larger plate, and a complementary registration opening 196 extends into the larger plate. When the weight 180 is flipped and positioned on top of the weight 190 as described previously, the opening 196 in the upper weight 180 receives the peg 195 on the lower weight 190, and the opening 196 in the lower weight 190 receives the peg 195 on the upper weight 180, thereby maintaining the upper weight 180 in an aligned position relative to the lower weight 190.

Each weight 180 and 190 is preferably a cast metal part. Alternatively, the weights 180 and 190 may be made in different manners and/or from different materials, including, for example, an injection molded plastic shell that surrounds and contains a relatively denser filler material. In any event, each weight 180 and 190 may be described as a plate or combination of plates having an overall thickness that is measured parallel to the axis X (shown in FIG. 3).

As shown in FIG. 4, when the weight lifting member 120 occupies a neutral or intermediate orientation relative to the weights 180 and 190, the weights 180 and 190 are hidden when the kettlebell 100 is viewed from above. As shown in FIG. 5, when the weight lifting member 120 is rotated counter-clockwise ten degrees (when viewed from above), the tabs or portions of the upper weight 180, which are designated as 188 for clarity, protrude through respective slots 128 and are visible from above. Similarly, as shown in FIG. 6, when the weight lifting member 120 is alternatively rotated clockwise ten degrees (when viewed from above), the tabs or portions of the lower weight 190, which are designated as 199 for clarity, protrude through respective slots 129 and are visible from above.

On the preferred embodiment 100, at least the exposed portions 188 of the upper weight 180 area first color, and at least the exposed portions 199 of the lower weight 190 are a second color. As a result of this color scheme, the exposed color or lack thereof can be used to indicate how much force is required to lift the weight lifting member 120. For example, as shown in FIG. 1, a weight indicator 130 may be provided on top of the housing 127. The diametrically opposed dots with "M" in the center are the first color and indicate a setting of medium or seven pounds when the first color portions or tabs 188 are exposed. The diametrically opposed dots with "H" in the center are the second color and indicate a setting of high or ten pounds when the second color portions or tabs 199 are exposed. Finally, the diametrically opposed dots with "L" in the center are a third color, preferably the same color as the housing 127, and indicate a setting of low or four pounds when neither the first color nor the second color is exposed.

The present invention may also be described in terms of methods with reference to the embodiment(s) described previously. For example, the present invention provides a method of adjusting weight resistance to exercise, comprising the steps of providing a stack of weights, including an upper weight and a lower weight, wherein the upper weight is configured to occupy an aligned position on top of the lower weight; aligning a weight lifting member relative to the stack of weights, so that a first shelf in the weight lifting member laterally aligns with a portion of the upper weight, and a second shelf in the weight lifting member laterally aligns with a portion of the lower weight; rotating the weight lifting member in a first direction to capture the upper weight on the first shelf; and alternatively rotating the weight lifting member in a second direction to capture the lower weight on the second shelf.

The present invention has been described with reference to specific embodiments and a preferred application. Persons skilled in the art will recognize that features on various embodiments may be mixed and matched to arrive at additional embodiments. Moreover, this disclosure will enable persons skilled in the art to derive various modifications, improvements, and/or applications that nonetheless embody the essence of the invention. Accordingly, the scope of the present invention is to be limited only to the extent of the following claims.

What is claimed is:

1. An adjustable weight kettlebell, comprising:

a stack of weights, including an upper weight, and a lower weight, wherein the upper weight is configured to occupy an aligned position on top of the lower weight;

a weight lifting member configured to occupy an aligned position on top of the upper weight, wherein the weight lifting member includes (a) a handle; and (b) a housing secured beneath the handle and defining a first shelf that is selectively rotatable beneath a portion of the upper weight, and a second shelf that is selectively rotatable beneath a portion of the lower weight; and a latch movably mounted on the weight lifting member and selectively movable into and out of engagement with at least the upper weight; wherein when the weight lifting member occupies a first orientation relative to the weights, the weight lifting member is free to move upward relative to each said weight; and when the weight lifting member occupies a second orientation relative to the weights, the first shelf underlies the upper weight, and only the upper weight is constrained to move upward together with the weight lifting member; and when the weight lifting member occupies a third orientation relative to the weights, the second shelf underlies the lower weight, and each said weight is constrained to move upward together with the weight lifting member.

2. The adjustable weight kettlebell of claim 1, wherein rotation of the weight lifting member from the second orientation to the third orientation rotates the first shelf out from underlying engagement of the upper weight.

3. The adjustable weight kettlebell of claim 1, wherein a protuberance projects upward from the lower weight and into an opening in the upper weight to maintain a desired orientation between the lower weight and the upper weight.

4. The adjustable weight kettlebell of claim 1, wherein the first shelf is defined at least in part by a first slot in a sidewall of the housing, and the second shelf is defined at least in part by a second slot in the sidewall of the housing.

5. The adjustable weight kettlebell of claim 1, wherein the housing defines a third shelf that is selectively rotatable beneath a discrete portion of the upper weight, and a fourth shelf that is selectively rotatable beneath a discrete portion of the lower weight.

6. The adjustable weight kettlebell of claim 5, wherein the weight lifting member is rotatable about an axis of rotation, and the first shelf and the third shelf are diametrically opposed relative to the axis, and the second shelf and the fourth shelf are diametrically opposed relative to the axis.

7. The adjustable weight kettlebell of claim 1, wherein the upper weight is identical in size and configuration to the lower weight.

8. The adjustable weight kettlebell of claim 7, wherein said portion of the upper weight is proximate a lowermost surface of the upper weight, and said portion of the lower weight is proximate an uppermost surface of the lower weight.

9. An adjustable weight kettlebell, comprising:

a stack of weights, including an upper weight, and a lower weight, wherein the upper weight is configured to occupy an aligned position on top of the lower weight;

a weight lifting member configured to occupy an aligned position on top of the upper weight, wherein the weight lifting member includes (a) a handle; and (b) a housing secured beneath the handle and defining a first shelf that is selectively rotatable beneath a portion of the upper weight, and a second shelf that is selectively rotatable beneath a portion of the lower weight; and when the weight lifting member occupies a first orientation relative to the weights, the weight lifting member is free to move upward relative to each said weight, and said portion of the upper weight is hidden from above by the housing; and when the weight lifting member occupies a second orientation relative to the weights, the first shelf underlies the upper weight, and only the upper weight is constrained to move upward together with the weight lifting member, and said portion of the upper weight is at least partly visible from above; and when the weight lifting member occupies a third orientation relative to the weights, the second shelf underlies the lower weight, and each said weight is constrained to move upward together with the weight lifting member.

10. The adjustable weight kettlebell of claim 9, wherein said portion of the lower weight is at least partly visible from above when the weight lifting member occupies the third orientation relative to the weights, and said portion of the lower weight is hidden from above by the housing when the weight lifting member occupies the first orientation relative to the weights.

11. The adjustable weight kettlebell of claim 10, wherein said portion of the upper weight is a first color, and said portion of the lower weight is a second color.

12. The adjustable weight kettlebell of claim 11, wherein the first color appears on the weight lifting member to indicate a weight setting associated with engagement of the upper weight, and the second color appears on the weight lifting member to indicate a weight setting associated with engagement of the lower weight.

13. The adjustable weight kettlebell of claim 9, wherein the first shelf is defined at least in part by a slot in a sidewall of the housing.

14. An adjustable weight kettlebell, comprising:

a stack of weights, including a lower weight and an upper weight, wherein the upper weight is configured to occupy an aligned position on top of the lower weight;

a weight lifting member having (a) a handle, and (b) a housing secured beneath the handle, wherein the housing is sized and configured to accommodate the weights and selectively rotate out of and into underlying engagement of the weights; and a latch movably mounted on the weight lifting member for movement into and out of engagement with at least the upper weight and biased to occupy a position that engages at least the upper weight to resist rotation of the housing relative to the weights when the weight lifting member occupies an aligned position on top of the upper weight.

15. The adjustable weight kettlebell of claim 14, wherein a portion of the upper weight projects into a first slot in the housing when the weight lifting member is rotated in a first direction relative to the weights, and a portion of the lower weight projects into a second slot in the housing when the weight lifting member is rotated in an opposite, second direction relative to the weights.

16. The adjustable weight kettlebell of claim 15, wherein said portion of the upper weight is a first color, and said portion of the lower weight is a second color.

17. The adjustable weight kettlebell of claim 16, wherein the first color is visible from above when said portion of the upper weight projects into the first slot in the housing, and the second color is visible from above when said portion of the lower weight projects into the second slot in the housing.

18. The adjustable weight kettlebell of claim 16, wherein the first color appears on the weight lifting member to indicate a weight setting associated with engagement of the upper weight, and the second color appears on the weight lifting member to indicate a weight setting associated with engagement of the lower weight.

19. An adjustable weight kettlebell, comprising:

a stack of weights, including an upper weight, and a lower weight, wherein the upper weight is configured to occupy an aligned position on top of the lower weight;

a weight lifting member configured to occupy an aligned position on top of the upper weight, wherein the weight lifting member includes (a) a handle; and (b) a housing sized and configured to encompass the weights, and the housing is secured beneath the handle and defines a first shelf that is selectively rotatable beneath a portion of the upper weight, and a second shelf that is selectively rotatable beneath a portion of the lower weight; and when the housing occupies a first orientation relative to the weights, the housing is free to move upward relative to each said weight; and when the housing occupies a second orientation relative to the weights, the first shelf underlies the upper weight, and only the upper weight is constrained to move upward together with the housing; and when the housing occupies a third orientation relative to the weights, the second shelf underlies the lower weight, and each said weight is constrained to move upward together with the housing.

20. The adjustable weight kettlebell of claim 19, wherein when the weight lifting member occupies the aligned position on top of the upper weight, the handle is available for grasping in a person's hand at a vertical distance above the housing.

21. The adjustable weight kettlebell of claim 19, wherein part of the upper weight projects through a sidewall of the housing when the housing occupies said second orientation.

* * * * *